United States Patent [19]

Stevens

[11] Patent Number: 4,649,826

[45] Date of Patent: Mar. 17, 1987

[54] RETARDATION SYSTEM FOR AIR LAUNCHED FLARES AND SUBMUNITIONS

[75] Inventor: George L. Stevens, North Ogden, Utah

[73] Assignee: Morton Thiokol Inc., Chicago, Ill.

[21] Appl. No.: 839,235

[22] Filed: Mar. 13, 1986

[51] Int. Cl.[4] ..... F42B 4/28

[52] U.S. Cl. ..... 102/340; 102/342; 102/345; 102/348; 102/351; 102/381

[58] Field of Search ..... 102/340, 342, 345, 348, 102/351, 381

[56] References Cited

U.S. PATENT DOCUMENTS 3,910,189 10/1975 Whidden et al. ..... 102/351
3,930,448 1/1976 Barber et al. ..... 102/351 X
4,335,656 6/1982 Beatty et al. ..... 102/351 X
4,342,252 8/1982 Hagelberg et al. ..... 102/351 X

*Primary Examiner*—Peter A. Nelson
*Attorney, Agent, or Firm*—Gerald K. White

[57] ABSTRACT

A tandem arrangement of a flare and a booster rocket motor is held together by a hollow coupler having hinged spring-loaded wall segments resembling barrel staves that are released on launch to function as a braking device, similar to a drogue parachute. The coupler also contains the main parachute which is released when the rocket motor is separated from the flare. The spring loading on the coupler wall segments controls the parachute drag area as a function of air speed enabling a relatively constant deceleration rate to be realized during the transition from high speed to the final descent velocity.

9 Claims, 7 Drawing Figures

RETARDATION SYSTEM FOR AIR LAUNCHED FLARES AND SUBMUNITIONS

BACKGROUND OF THE INVENTION

1. Field of the Invention

This invention relates to the deployment of flares or other submunitions at high speed conditions.

2. Description of the Prior Art

Flares or other submunitions which are carried aloft and dropped from aircraft are known in the prior art. A predetermined time interval after being dropped or launched, a slow descent device, specifically a parachute, is deployed. Automatic ignition of the illuminant contained within the flare is effected at parachute deployment. Such slow descent arrangements for illuminating the ground by flares from the air have been in use for many years.

During the deployment of flares or other submunitions at high speed conditions, as from a booster rocket, a two phase parachute system generally is used. The first phase is a drogue parachute deployment which slows the flare or other submunition from the high speed to an intermediate speed. The second phase is the deployment of a larger main parachute which slows the flare to its final descent velocity.

This sequence of drogue and main parachute deployment, in the deployment of flares or other submunitions at high speed conditions, has been plagued with many problems. High "snatch" forces can cause structural failure. Parachutes can become fouled, resulting in streamers. The parachutes have wrapped around the flare or other submunition, causing failure. Additionally, the initiating mechanism has been complicated, and not always reliable.

Thus, there exists a need and a demand in the art for simplification and improvement in retardation systems for air launched flares and other submunitions at high speed conditions. The present invention was devised to fill the technological gap that exists in the art in this respect.

SUMMARY OF THE INVENTION

An object of the invention is to provide in a retardation system for air launched flares and submunitions deployed at high speed conditions a single retarding mechanism that serves the combined functions of the drogue and main parachutes.

Another object of the invention is to provide such a retarding mechanism that is self-compensating for flight velocity by varying the drag area of the main parachute to be a function of air speed whereby a relatively constant deceleration rate can be realized during the transition from high speed to the final descent velocity.

A further object of the invention is to provide such a retarding mechanism that features controlled deployment of the main parachute such that the main parachute is guided during its inflation, thus minimizing the possibility of malfunction and consequent failure.

In accomplishing these and other objectives of the invention, there is provided a tandem arrangement of a flare or other submunition and a booster rocket motor held together by a hollow coupler. The coupler includes spring loaded wall segments resembling barrel staves that are released at launch under high speed conditions to function as an air braking device, similar to a drogue parachute. The coupler also contains the main parachute, which is released when the rocket motor is separated from the flare.

The various features of novelty which characterize the invention are pointed out with particularity in the claims annexed to and forming a part of this specification. For a better understanding of the invention, its operating advantages, and specific objects attained by its use, reference is made to the accompanying drawings and descriptive matter in which a preferred embodiment of the invention is illustrated.

BRIEF DESCRIPTION OF THE DRAWINGS

With this summary of the invention, a detailed description follows with reference being made to the accompanying drawings which form part of the specification, of which.

DESCRIPTION OF THE PREFERRED EMBODIMENT

Figure 3:
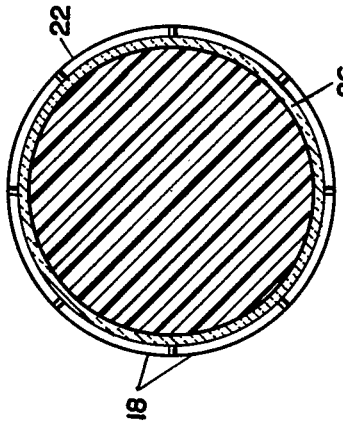
FIG. 3 is a cross sectional view taken along the lines 3—3 of FIG. 1.
Figure 1:
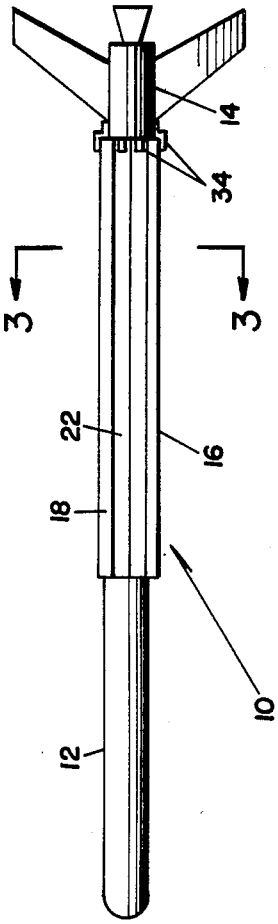
FIG. 1 is a side view of a tandem arrangement of a flare assembly and booster rocket motor held together by a coupler according to the invention.
Figure 2:
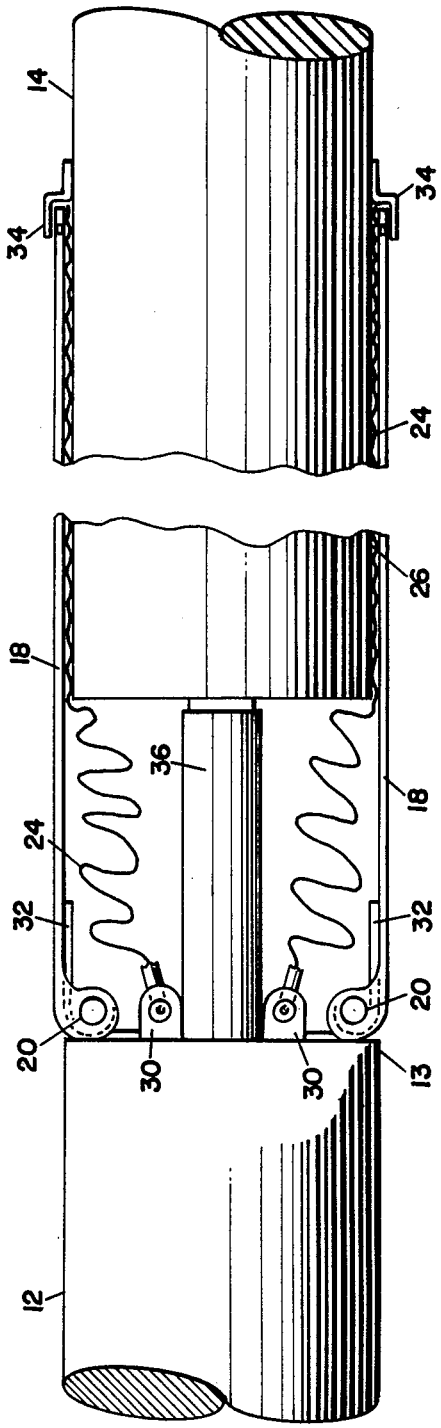
FIG. 2 is a fragmented side view on an enlarged scale of a portion of the arrangement of FIG. 1.

Referring to the drawings, there is shown in FIGS. 1–3 a tandem arrangement 10 of a flare assembly 12 and a booster rocket motor 14 held together by a coupler 16. The coupler 16 comprises a plurality of staves 18. Eight staves are employed in the illustrated embodiment of the invention. Each of the staves 18 is hinged at a first end by a respectively associated hinge 20 to the aft end 13 of the flare 12. The staves 18 extend rearwardly adjacent the surace of the case 15 booster rocket motor 14.

Each stave 18 has a concave cross section, as best seen in FIG. 3. Thus, when stored against the booster rocket motor 14, they form a shell structure 22 to contain a stored main parachute 24. The stored parachute 24 is thermally insulated from the case 15 of the booster rocket motor 14 by ceramic fiber insulation 26.

A line 28 which is integral with the peripheral edge of the main parachute 24 is attached at equally spaced intervals to the outboard or second end of each of the staves 18. The center part of the parachute 24 is attached to the flare 12 by retaining lugs 30.

Preferably, in accordance with the invention, the staves 18 are made of an aramid polymer or graphite/epoxy composite to provide high strength and low weight. A particularly suitable aramid polymer is that which is commercially available from E. I. duPont de Nemours and Company, Wilmington, Delaware, under its various trademarks KEVLAR®, KEVLAR®-29, KEVLAR®-49 and NOMEX®. The term "aramid polymer," as used herein, means a synthetic polymeric resin generally designated in the art as an aromatic polycarbonate or aromatic polyamide fiber. "Aramid polymer" is disclosed in Technical Disclosure T950,008 (950 O.G. 6), published Sept. 7, 1976, and based on an application originally filed Feb. 18, 1976, as being a polymer described in U.S. Pat. Nos. 3,652,510; 3,699,085; and 3,653,143.

Each of the staves 18 is spring loaded or biased for outward movement away from the booster rocket motor 14 about its respectively associated hinge 20 by a separate torsion spring 32. More specifically, a torsion spring 32 is provided at each of the locations of the hinges 20. When in the stored condition, each of the staves 18 is restrained against such outward movement by a respectively associated retainer clip 34 that is fixedly attached to the booster rocket motor 14.

A thruster 36 carried at the aft end of flare 12, as seen in FIG. 2, is provided for separating the flare 12 and the booster rocket motor 14. When the booster rocket motor 14 is ejected by the thruster 36, each of the staves 18 of coupler 10 slides forward relatively to its associated retainer clip 34 and is released for outward rotation about its respective hinge 20 by its associated torsion spring 32. Upon such release from the restraining action of the clips 34, the outwardly spreading staves 18, in umbrella-like manner initially function as a braking device, similar to a drogue parachute.

Figure 5:
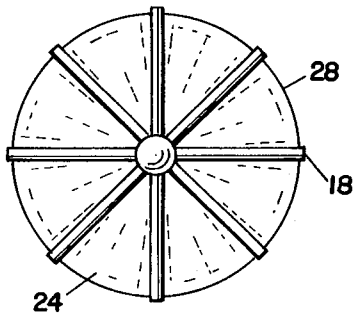
FIG. 5 is a view from the forward end of the partially deployed coupler components and main parachute canopy.
Figure 4:
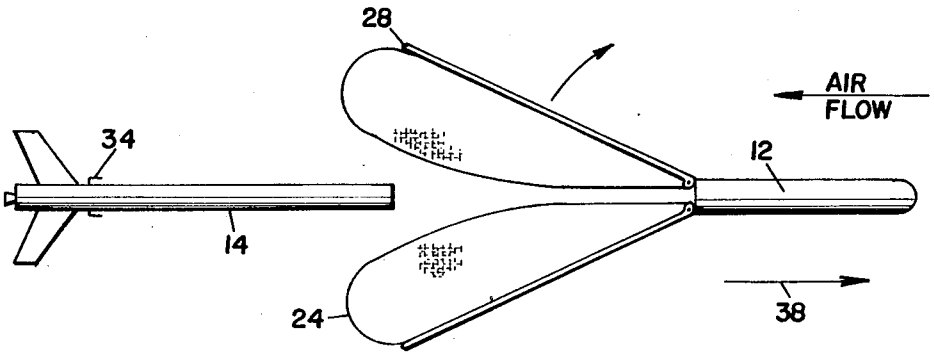
FIG. 4 is a side view, with certain of the coupler components removed as in FIG. 2, showing an early stage of the separation of the coupler and flare from the booster rocket motor while moving at high speed in the direction of the arrow.

As previously mentioned, the coupler 10 also contains the main parachute 24. Thus, upon release of the staves 18 from clips 24 and separation of the booster rocket motor 14 from the flare 12, the main parachute 24 is also released. The main parachute 24 is guided during the inflation thereof by the attachment of line 28 thereof at spaced intervals to the outboard or second ends of the staves 18. FIGS. 4 and 5 show an early stage of the separation of the coupler 16 and flare 12 from the booster rocket motor 14 while the assemblage 10 is moving at high speed in the direction of the arrow 38.

Figure 7:
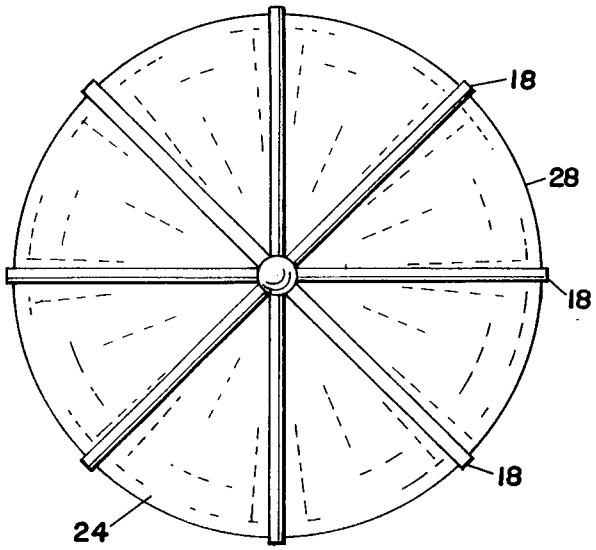
FIG. 7 is a view from the forward end of the fully deployed coupler components and the main parachute canopy.
Figure 6:
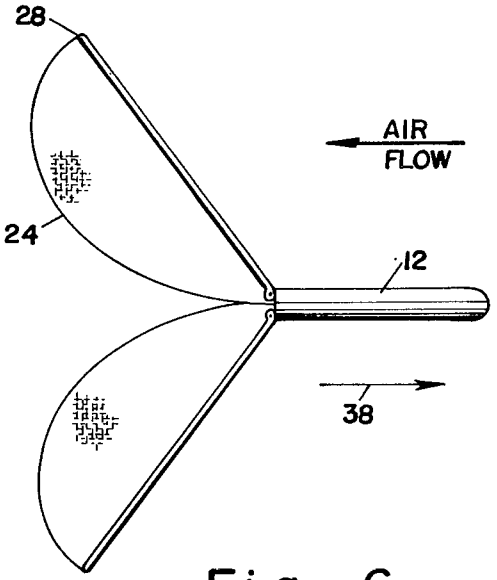
FIG. 6 is a side view, with portions of the coupler components removed, at a later stage in the deployment of the flare with the latter moving at a relatively slow speed.

The torsion springs 32 control the extent to which the staves 18 are rotated outwardly, and hence, the drag area of the main parachute 24, as a function of air speed. At high speeds, the aerodynamic forces cause a reduction of parachute drag area by creating a high moment to compress the torsion springs 32. As the air speed reduces, the springs 32 force the staves 18 to rotate outwardly, allowing the main parachute 24 to open further, generating a larger drag area, as illustrated in FIGS. 6 and 7.

Thus, in accordance with the invention, there has been provided a retardation system for air launched flares and submunitions that are deployed at high speed conditions by a single retarding mechanism that serves the combined functions of the drogue and main parachutes. The retarding mechanism is characterized in that the deceleration rate is controlled by the torsion spring load on the staves 18; the parachute 24 is guided during its inflation; and the drag area of the parachute 24 is a function of the dynamic air pressure of flight.

With this description of the invention in detail, those skilled in the art will appreciate that modifications may be made to the invention without departing from its spirit. Therefore, it is not intended that the scope of the invention be limited to the specific embodiment that is illustrated and described. Rather, it is intended that the scope of the invention be determined by the appended claims and their equivalents.

What is claimed is:

1. A retardation system for air launched devices comprising, a device to be air launched, a booster rocket motor to launch said device, said booster rocket motor having an aft end and a forward end, a coupler interconnecting said device to the forward end of said booster rocket motor, said coupler comprising a plurality of staves each of which has a concave cross section and a first end and a second end with said first end hinged to said device, said staves when in stored condition extending toward the aft end of said booster rocket motor along the forward end thereof and forming a shell structure, a parachute stored within said shell structure between said device and said booster rocket, said parachute having peripheral regions thereof connected to the second end of each of said staves and a central region connected to said device, spring means biasing each of said staves outwardly away from said booster rocket motor, releasable retaining means attached to said booster rocket motor to retain said staves in said stored condition, and means to eject said booster rocket motor from said device and thereby to release said staves from retention by said retaining means, whereby said staves are released and are deployed outwardly by the biasing force of said spring means and function as a brake to decelerate said device and allow the deployment of said parachute to begin, said staves and spring means controlling the drag area of said parachute as a function of air speed of said device.

whereby the rate of deceleration of said device is relatively constant during the transition from high speed to the final descent velocity.

2. A retardation system as defined by claim 1 wherein said staves are made of an aramid composite.

3. A retardation system as defined by claim 1 wherein said staves are made of a graphite/epoxy mixture.

4. A retardation system as defined by claim 1 further including means thermally insulating said stored parachute from said booster rocket motor.

5. A retardation system as defined by claim 1 wherein said insulating means comprises a ceramic fiber insulation.

6. A retardation system as defined by claim 1 wherein said spring means comprise a separate torsion spring for biasing each of said staves.

7. A retardation system as defined by claim 1 wherein said retaining means comprises a separate clip attached to said booster rocket motor for each of said staves.

8. A retardation system as defined by claim 1 wherein said retaining means comprises a separate clip attached to said booster rocket motor for each of said staves with each of said clips embracing the second end of a respectively associated stave and allowing relative sliding movement therewith whereby upon ejection of said booster rocket motor from said device to be air launched the second end of each of said staves is moved out of the embrace of the respectively associated clip.

9. A retardation system as defined by claim 1 wherein said means to eject said booster rocket motor from said device is a thruster.

* * * * *